US008359879B2

(12) United States Patent
Kim et al.

(10) Patent No.: US 8,359,879 B2
(45) **Date of Patent: *Jan. 29, 2013**

(54) REFRIGERATOR AND DEGASSING CONTAINER FOR REFRIGERATOR

(75) Inventors: Jeong-Yon Kim, Changwon (KR); Jong-Min Shin, Changwon (KR); Bong-Jun Choi, Changwon (KR); Su-Won Lee, Changwon (KR); Ill-Shin Kim, Changwon (KR); Seok-Min Lim, Changwon (KR)

(73) Assignee: LG Electronics Inc., Seoul (KR)

( * ) Notice: Subject to any disclaimer, the term of this patent is extended or adjusted under 35 U.S.C. 154(b) by 397 days.

This patent is subject to a terminal disclaimer.

(21) Appl. No.: 12/673,113

(22) PCT Filed: Sep. 19, 2008

(86) PCT No.: PCT/KR2008/005583

§ 371 (c)(1),
(2), (4) Date: Feb. 11, 2010

(87) PCT Pub. No.: WO2009/038403

PCT Pub. Date: Mar. 26, 2009

(65) Prior Publication Data

US 2011/0289957 A1 Dec. 1, 2011

(30) Foreign Application Priority Data

Sep. 21, 2007 (KR) ..... 10-2007-0096989

(51) Int. Cl.
*F25D 17/04* (2006.01)

(52) U.S. Cl. ..... 62/404; 62/408; 62/455

(58) Field of Classification Search ..... 62/404, 62/408, 455, 449, 100, 169, 268, 302, 382
See application file for complete search history.

(56) References Cited

U.S. PATENT DOCUMENTS

| | | | | |
|---|---|---|---|---|
| 3,948,213 | A * | 4/1976 | Hoyer et al. | 118/50 |
| 3,961,918 | A * | 6/1976 | Johnson | 96/165 |
| 4,520,950 | A * | 6/1985 | Jeans | 222/129.1 |
| 4,659,345 | A * | 4/1987 | Mojonnier | 96/158 |

(Continued)

FOREIGN PATENT DOCUMENTS

| | | | |
|---|---|---|---|
| JP | 6-18152 | A | 1/1994 |
| KR | 10-1999-0033606 | A | 5/1999 |

(Continued)

*Primary Examiner* — Mohammad Ali
(74) *Attorney, Agent, or Firm* — Birch, Stewart, Kolasch & Birch, LLP

(57) ABSTRACT

The present invention relates to a refrigerator and a degassing container of the refrigerator which compulsorily degass a portion of air inside a space where foods are stored to the outside by a degassing means together with deformation of a gasket when a door is closely adhered. The present invention includes a degassing container of a refrigerator comprising a case whose one side is opened; a door which shields the opened one side of the case selectively; a gasket interposed between the door and case and elastically deformed to be closely adhered when the door is shielded; a degassing means provided on the door and exhausting air inside the case to the outside when the gasket is compressively deformed; and a release means provided on the door and flowing external air into an inner side of the case when the door is opened. According to the present invention, the storage performance is improved.

24 Claims, 4 Drawing Sheets

U.S. PATENT DOCUMENTS

| | | | | |
|---|---|---|---|---|
| 4,782,886 | A * | 11/1988 | Uchida et al. | 164/305 |
| 4,966,780 | A * | 10/1990 | Hargraves et al. | 426/118 |
| 6,168,948 | B1 * | 1/2001 | Anderson et al. | 435/287.2 |
| 6,263,691 | B1 * | 7/2001 | Ueno et al. | 62/292 |
| 6,478,966 | B2 * | 11/2002 | Zhou et al. | 210/638 |
| 6,951,340 | B2 * | 10/2005 | Suzuki et al. | 277/650 |
| 7,380,975 | B2 * | 6/2008 | Tessien | 366/114 |
| 8,161,997 | B2 * | 4/2012 | Hoglund et al. | 137/334 |
| 2004/0035491 | A1 * | 2/2004 | Castellano | 141/27 |
| 2004/0108006 | A1 * | 6/2004 | McLane et al. | 137/625.47 |
| 2004/0108007 | A1 * | 6/2004 | McLane et al. | 137/625.47 |
| 2005/0098032 | A1 * | 5/2005 | Tsai | 95/46 |
| 2005/0192530 | A1 * | 9/2005 | Castellano | 604/70 |
| 2005/0202504 | A1 * | 9/2005 | Anderson et al. | 435/6 |
| 2005/0275821 | A1 * | 12/2005 | Miyajima | 355/69 |
| 2006/0159560 | A1 * | 7/2006 | Tessien | 417/313 |
| 2006/0246490 | A1 * | 11/2006 | Anderson et al. | 435/6 |
| 2008/0212398 | A1 * | 9/2008 | Tessien | 366/114 |

FOREIGN PATENT DOCUMENTS

| | | | |
|---|---|---|---|
| KR | 10-2001-0027237 | A | 4/2001 |

* cited by examiner

REFRIGERATOR AND DEGASSING CONTAINER FOR REFRIGERATOR

TECHNICAL FIELD

The present invention relates to a refrigerator and a degassing container for the refrigerator.

BACKGROUND ART

Generally, a refrigerator is a home appliance for storing foods in the inside of the refrigerator shielded by a handle thereof at a low temperature, and can store the stored foods in an optimal state by cooling the inside of the storage space using cold air generated by the heat exchange with refrigerant that circulates a freezing cycle.

The demand for large and multi-functional refrigerators according to the change and improvement in dietary life has been grown. Taking users' convenience into consideration, products having diverse forms and convenient devices have thereby been released.

The inside of the refrigerator may be partitioned by shelves, drawers, baskets, or the like, and the foods may be received in each storage space partitioned thereby. In particular, in the space receiving foods in an airtight state or a state equivalent thereto such as drawers, foods, which are separated and received from other foods, may be stored. Also, foods, which are sensitive to temperature and moisture such as vegetables, are generally stored.

In order to store the foods such as vegetables in the storage space such as drawers for a long time, the inside of the storage space may be filled with as little air as possible. To this end, there is provided a configuration to degass air inside the storage space.

Korean Patent Registration Nos. 0547426 and 0606728 disclose a refrigerator to degass air inside a storage space, wherein a portion of air inside the storage space is thereby exhausted to the outside to reduce the amount of air inside the storage space, so the storage performance of foods can be improved.

However, in Korean Patent Registration No. 0547426, the airtight between a tray and a cover is hardly guaranteed, and the cover must be able to move up and down so as to operate the airtight of the storage space, so an upper portion of the cover must have a space for the operation, thereby causing a problem that the receiving space is lost. Furthermore, efficient close-adhering and degassing can be performed only when the entirety of the cover moves simultaneously, thereby causing a problem that the operation therefor is not easy.

In Korean Patent Registration No. 0606728, air is exhausted backward, that is, in a direction that a storage container is drawn in, to have a difficulty in exhausting air smoothly, and the storage container must be compulsorily opened in order that external air enters the inside of the storage container for opening the storage container, thereby causing a problem that use convenience is not good.

DISCLOSURE OF INVENTION

Technical Problem

Embodiments provide a refrigerator and a degassing container of the refrigerator which compulsorily degass a portion of air inside a space where foods are stored to the outside by a degassing means together with deformation of a gasket when a door is closely adhered.

Technical Solution

According to an exemplary embodiment of the present invention, there is provided a degassing container of a refrigerator comprising a case whose one side is opened; a door which shields the opened one side of the case selectively; a gasket interposed between the door and case and elastically deformed to be closely adhered when the door is shielded; a degassing means provided on the door and exhausting air inside the case to the outside when the gasket is compressively deformed; and a release means provided on the door and flowing external air into an inner side of the case when the door is opened.

According to an exemplary embodiment of the present invention, there is provided a degassing container of a refrigerator comprising a drawer provided in an inner side of a storage space, the drawer capable of being slidingly drawn in and out; a door drawn in and out together with the drawer and shielding the storage space selectively; a gasket made of elastically deformable material, the gasket provided on the door and closely adhered to a front end of the storage space; and a degassing means provided on the door or one side of the storage space, the degassing means controlling the entrance of air inside the storage space according to the elastic deformation of the gasket.

According to an exemplary embodiment of the present invention, there is provided a refrigerator comprising a body which forms a storage space; one or more refrigerator doors which shield the storage space selectively; a case provided in the inner side of the storage space and forming a separately pardoned space; a door which shields an opened front surface of the case selectively; a gasket provided around a rear surface of the door and closely adhered to the case selectively to be elastically deformed; a degassing means provided on the door and opened only when the gasket is compressively deformed to allow air inside the case to be exhausted to the outside; an opening handle mounted to the door and rotatably operated; a release means provided on the door and selectively opened according to the operation of the opening handle to allow external air to be flowed into the inner side of the case.

According to an exemplary embodiment of the present invention, there is provided a refrigerator comprising a body which forms a storage space; a degassing container provided in the storage space and having a door which shields the case selectively; a gasket provided between the case and door and compressively deformed when the door is shielded to close an inside of the degassing container; a degassing means provided on one side of the degassing container and exhausting air inside the case to the outside only when the gasket is compressively deformed; and a release means provided on the other side of the degassing container and allowing air to be selectively flown into the inside of the case according to a user's operation.

Advantageous Effects

According to the provided embodiment, storage performance improve because a portion of air inside a space where foods are stored to the outside compulsorily degass by a degassing means together with deformation of a gasket when a door is closely adhered.

MODE FOR THE INVENTION

Hereinafter, the exemplary embodiments of the present invention will be described in detail with reference to the accompanying drawings. However, the present invention is not limited to the present embodiments but may be easily implemented as other embodiments included within the scope of the present invention by adding, modifying or deleting other constituents.

A degassing container for a refrigerator according to the present invention may be applied to diverse types of refrigerators, such as a top mount type refrigerator, a bottom freeze type refrigerator, a side by side type refrigerator, or the like.

Hereinafter, a case to which a side by side type refrigerator is applied will be described as an example, for convenience of explanation.

Figure 1:
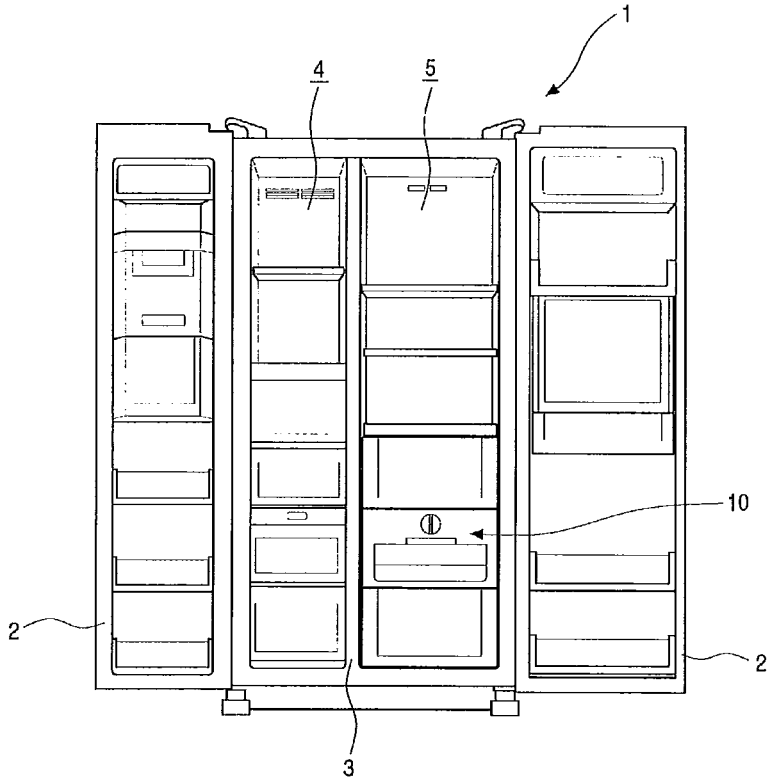
FIG. 1 is a front view showing that a door of a refrigerator according to an exemplary embodiment of the present invention is opened.

FIG. 1 is a front view showing that a door of a refrigerator according to an exemplary embodiment of the present invention is opened. Referring to FIG. 1, the exterior of the refriger is formed in an approximate rectangular parallelepiped shape and configured of a body 1 which forms a storage space and a refrigerator door 2 which shields the body.

The inner side of the body 1 is entirely partitioned right and left by a barrier 3 to form a freezing chamber 4 and a refrigerating chamber 5. The respective freezing chamber 4 and refrigerating chamber 5 are selectively shielded by the refrigerator door 2 rotatably mounted to the body 1.

Inside the freezing chamber 4 and refrigerating chamber 5, receiving members, such as a lot of shelves, drawers, and baskets, are provided to partition the inside thereof, wherein the drawers are constituted to be able to be slidingly drawn in and out forward and backward inside the body 1 so the drawers can be selectively opened and closed.

The drawer forms an independent space inside the freezing chamber 4 or the refrigerating chamber 5 to enable foods stored therein to be stored at different temperatures and/or humidities from other foods. The drawer may generally be used as a vegetable room where foods or vegetables are stored, a quick-freezing room for quick freezing, or a temperature switching room where meats and fishes are stored by controlling the temperature.

Among others, a vegetable room provided in the refrigerating chamber 5 may be formed by a degassing container 10 according to the present invention. The vegetable room formed by the degassing container 10 has a relatively short storage period of foods stored therein, so the vegetable room may become a vacuum-like state by reducing the amount of air therein, making it possible to extend the storage period of foods and to store the foods more freshly.

Figure 2:
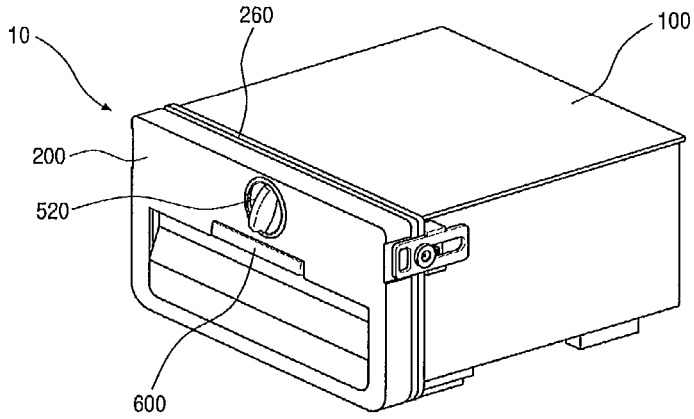
FIG. 2 is a perspective view showing an exterior of a degassing container according to an exemplary embodiment of the present invention.
Figure 3:
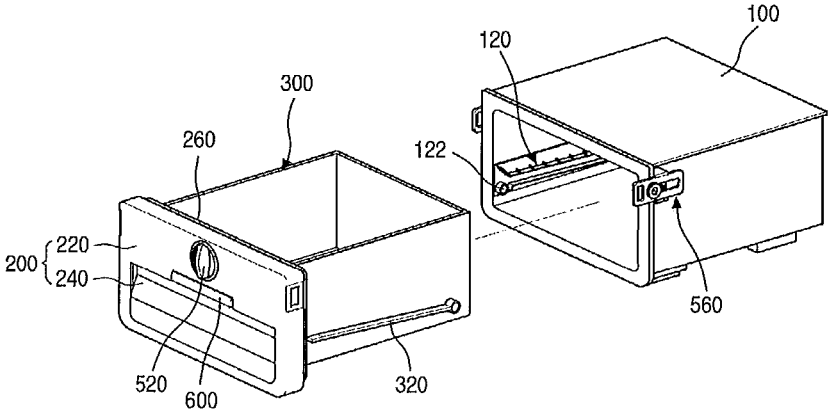
FIG. 3 is an exploded perspective view showing that a door or a degassing container according to an exemplary embodiment of the present invention is opened.

FIG. 2 is a perspective view showing an exterior of a degassing container according to an exemplary embodiment of the present invention, and FIG. 3 is an exploded perspective view showing that a door of a degassing container according to an exemplary embodiment of the present invention is opened.

Referring to FIGS. 2 and 3, an exterior of a degassing container 10 is formed by a case 100 which forms a storage space and a door 200 which opens and closes the storage space of the case 100.

The case 100, which is mounted to an inner side of a refrigeration chamber 5, is formed in an approximate rectangular parallel piped shape to form a space inside thereof and to be opened forward. The case 100 may be formed of adiabatic materials not to be affected by a temperature, as a space independent from the refrigerating chamber 5, or may be formed to be detachable from the inner side of the refrigerating chamber 5.

Meanwhile, the case 100 may be molded integrally with an inner side surface of the refrigerator body 1. In this case, the case 100 is formed by an inner case which forms the inner side surface of the refrigerating chamber 5 and is formed to be opened forward.

As needed, a shelf which partitions a space may be provided at the bottom of the refrigerating chamber 5, and a space between the shelf and a bottom surface of the inner side of the refrigerating chamber may be provided in the same shape of the case 100 to form a storage space of the degassing container 10.

Guide means 120 are provided in both right and left sides of the inside of the case 100. The guide means 120, which is for guiding the drawing in and out of the drawer received inside the case 100, is formed to protrude from the inner side of the case 100 and may comprise one or more rollers 122 for more smoothly sliding a drawer 30 to be described later.

The door 200, which shields the opened front surface of to case 100, is formed to have an approximate rectangular cross-section corresponding to the front surface of the case 100. A drawer 300 is provided on a rear surface of the door 200, wherein the drawer 300 is formed in size that can be received by the inner side of the case 100.

Guide ribs 320 are formed on both sides of the drawer 300. The guide rib 320, which is seated on a guide means 120 of the case, is constituted to contact the roller 122 of the guide means 120 in order that the drawer can be slidingly drawn out and in smoothly.

The door 200 includes a door base 240 and a door cover 220. The door base 240, which forms a rear surface of the door 200, is mounted with a plurality of constituents such as a restricting device 500, a degassing means 400, a release means 700 and the like to be described later.

The door cover 220, which forms a front surface of the door 200, shields the plurality of constituents mounted on the door base 240 and forms an exterior of the door 200.

A dial 520 which controls the operation of the restricting device 500 to be described in detail later is exposed on the front surface of the door 200, and restricting members 540 selectively protrude to both sides of the door 200 according to the operation of the dial 520 to be restricted to receiving member 560 of the case 100, thereby allowing the door 200 to be coupled to the case 100. Hereinafter, more detailed description thereof will be described.

A opening handle 600 which operates a release means 700 to form a pressure balance by allowing external air to be flowed into the inside of the storage space of the inner side of the case 100 is further provided on the lower side of the dial 520. The opening handle 600 is provided to be exposed to the front surface of the door 200 to enable the release means 700 to be opened by pulling the door 200 forward in front of the door 200. Of course, the opening handle 600 may also function as a handle which draws in the drawer 300 by opening the door 200.

A portion of the lower side of the door 200 downward from the opening handle 600 is configured to be able to check the foods which are currently stored inside of the drawer 300. To this end, a portion of the door cover 200 is formed to be opened, and at a least portion of the door base 240 corresponding to the door cover 220 may be made of transparent material.

Figure 4:
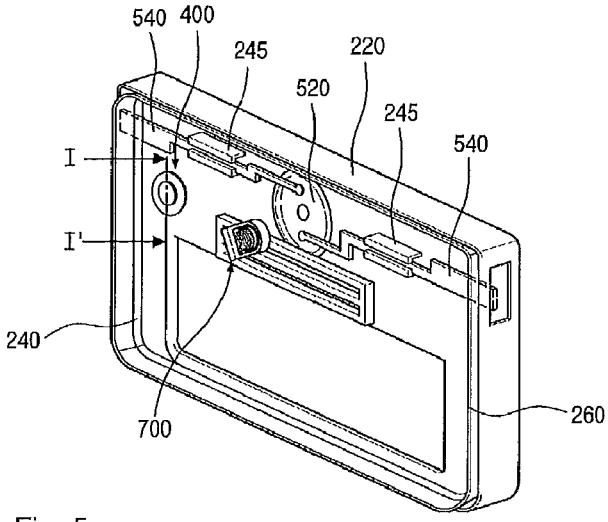
FIG. 4 is a perspective view showing a rear surface of a door of a degassing container of an exemplary embodiment of the present invention.

FIG. 4 is a perspective view showing a rear surface of a door of a degassing container according to an exemplary embodiment of the present invention.

Referring to FIG. 4, a gasket 260 is provided around the rear surface of the door 200. The gasket 260, which allows the door 200 and a front end of a case 100 to be closely adhered to each other when the door 200 is closed, tightly closes an inside of the case 100.

The gasket 260 is formed of material having a predetermined elasticity such as a silicon plastic material or the like, and is formed to enable the entire volume inside the case 100 to be reduced by being compressed by a predetermined interval in the case 100 direction when the door 200 is closed.

More specifically, the gasket 260 is formed along an outline of the rear surface of the door 200 and is extended backward by a predetermined length, making it possible to be compressed when contacting the front end of the case 100.

To this end, the gasket 260 may be formed in a plate shape having a relatively thin thickness, preferably, in a bent plate shape in order to have a predetermined curvature in an upward direction. This is the reason that when an extended end of the gasket 260 contacts the case 100, the gasket 260 is more easily elastically deformed so that the volume of a closed space formed by the case 100 and door 200 can be efficiently reduced.

At this time, as the extended length of the gasket 260 is longer, the compressed deformation is larger, making it possible to considerably reduce the volume of the closed space and to exhaust air inside the case 100 much more.

The gasket 260 may be applied with a general gasket whose inside is hollow or a gasket in other shape rather than the plate shape. If the gasket 260 can be sufficiently compressively deformed by contacting the case 100, any diverse forms of gasket may also be used.

Meanwhile, a release means 700 is provided on one side of the door 200 corresponding to the opening handle 600, and a degassing means 400 allowing air inside the case 100 to be exhausted to the outside when the door 200 is closed is provided on the other side of the door 200.

Figure 5:
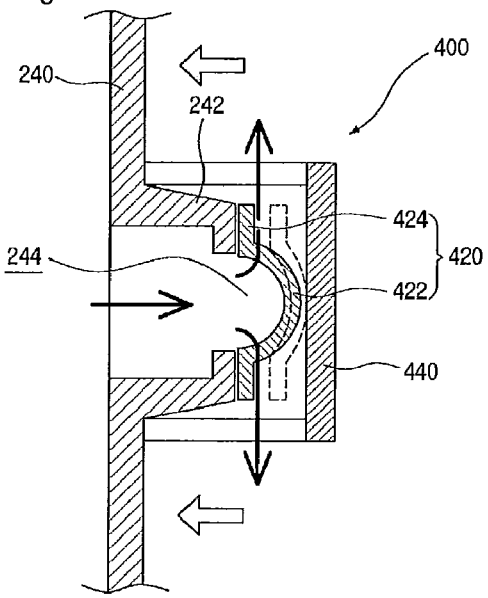
FIG. 5 is a cross sectional view showing a configuration of a degassing means according to an exemplary embodiment of the present invention.

FIG. 5 is a cross-sectional view showing a configuration of a degassing means according to an exemplary embodiment of the present invention. FIG. 5 is a cross-sectional view taken along lines I-I' of FIG. 4. The degassing means 400 will be described in detail with reference to FIGS. 4 and 5.

Referring to FIGS. 4 and 5, the degassing means 400, which operates when the door 200 is closed and allows the air inside the case 100 to be exhausted to the outside, may use a valve to be opened in only one direction from the inner side to outer side of the case 100.

Diverse configurations of the valve allowing a fluid to be flowed in only one direction described above have been well-known, so a valve having an appropriate configuration may be used as needed.

The degassing means 400 according to an exemplary embodiment of the present invention includes an exhaust port 244 farmed on the door 200, a valve plate 420 selectively shielding the exhaust port 244, and a restricting part 440 restricting the valve plate 420.

More specifically, the exhaust port 244 is formed on a controlling part 242. The supporting part 242 protrudes on one side of to door base 240, and the exhaust port 244 exhausts the air simultaneously with supporting the valve plate 420.

The exhaust port 244 penetrates through a rear surface of the door base 240 (a bottom side in FIG. 5) to a front surface of the supporting part 242 (an upper side in FIG. 5) so that the air inside the case 100 can be exhausted to the outside through the door 200.

Meanwhile, the opened front surface of the exhaust port 244 is shielded by the valve plate 420. the valve plate 420 is made of elastically deformable material and is formed to be deformable by the pressure of air exhausted through the exhaust port 244. As the valve plate 420 is deformed, the exhaust port 244 is selectively opened, so the air inside the case 100 can be exhausted to the outside.

More specifically describing a configuration of the valve plate 420, the valve plate 420 is formed in a disc shape having a space somewhat larger than an upper surface of the supporting part 242 and includes a controlling part 424 and an elastic part 422.

The elastic part 422, which forms an approximate center part of the valve plate 420, has the size corresponding to that of the exhaust port 244 and protrudes backward from the exhaust port 244 (the right direction in FIG. 5) in an hemisphere shape.

The controlling part 424 is extended from the outer end of the elastic part 422 in an outer direction to contact the upper surface of the supporting part 242, and the controlling part 424 may protrude somewhat more than the outer side of the supporting part 242.

The restricting part 140, which restricts the valve plate 420 not to be degassed, has an approximate '⊔' letter shape of cross-section and a predetermined width, seeing from a lateral side view. Both ends of the opened side of the restricting part 440 is fixed to the door base 240, and one side opposed to the opened side (right side in FIG. 5) is restricted to the valve plate 420 by pressing the valve plate 420 from the backward thereof.

When the air inside the case 100 is not exhausted to the outside through the exhaust port 244, the controlling part 424 of the valve plate 420 closely adhered to a rear surface of the supporting part 242 completely shields the exhaust port 244.

In such a state, when the air inside the case 100 is exhausted through the exhaust port 244, the pressure of air passing through the exhaust port 244 is applied to the elastic part 422, and a bottom side of the elastic part 422 in a state that is supported by the controlling part 424 is deformed outward by the pressure, so the controlling part 424 is separated from the rear surface of the supporting part 242. Therefor, the air exhausted through the exhaust port 244 is exhausted to the outside through between the controlling part 424 and the supporting part 242.

When the exhaust of air through the exhaust port 244 stops, the elastic part 424 is restored to the original shape by its elasticity, and the controlling part 424 is closely adhered to the rear surface of the supporting part 242 again by the restoration of the elastic part 422, making it possible to block the entrance of air.

In view of the property of shape of the valve plate 420, when outside air is to be flowed into the exhaust port 244, the valve plate 420 more tightly shields the exhaust port 244, making it possible to block the inflow of outside air.

Meanwhile, the degassing means 400 may also be formed on any position other than the door 200. For example, the degassing means 400 may be provided on the case 100, and at this time, the degassing means 400 is the same in the configuration but different only in the mounting position. In other words, when the degassing means 400 is mounted on the case 100, the air inside the case 100 may be exhausted to the outside through the degassing means 400 when the volume according to the close adhesion of the door 200 is changed.

Figure 6:
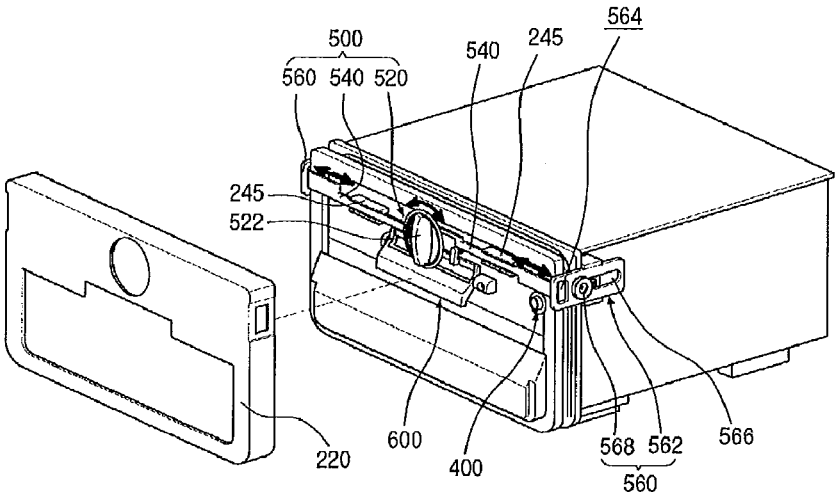
FIG. 6 is a perspective view showing a configuration of a restricting device according to an exemplary embodiment of the present invention.

FIG. 6 is a perspective view showing a configuration of a restricting device according to an exemplary embodiment of the present invention. Referring to FIG. 6, a restricting device 500 includes a dial 520, a restricting member 540, and a receiving member 560.

More specifically, the dial 520 in a disc shape is rotatably mounted on the door base 240 and is mounted to expose a handle 522 for operating the dial 520, thereby being rotatably operated by a user. A boss 241 (shown in FIG. 7) is formed on one side of the door base 240 to which a rotating shaft of the dial 520 is inserted, and a rotating guide 243 (shown in FIG. 7) which limit the rotation of the dial 520 is further formed on an upper side of the boss 241.

Each restricting member 540 is mounted on the rear surface of the dial 520. The restricting members 540, whish are selectively interfered with receiving members 560 to be described later to restrict the door 200, are formed in a rod shape having a predetermined length and each are provided on right and left sides.

One ends of the restricting member 540 each are rotatably coupled to upper portion and lower portion of the rear surface of the dial 520, and the other ends of the restricting member 540 each are extended to the restricting members 540 to be described later. In order to guide left and right movements of the restricting member 540, restricting member guides 245 are provided on both sides of the door base 240. Accordingly when the dial 520 operates, the restricting members 540 move right and left along the restricting member guides 245 to be able to be coupled to the receiving members 560 selectively.

The Receiving members 560 are provided on both sides of the case 100 corresponding to the outer ends of the restricting members 540. The receiving member 560 includes a restricting plate 562 formed in a plate shape and a fixture for fixing the restricting plate 562 to the case 100.

The restricting plate 562 is formed in a rectangular plate shape, and a restricting hole 564 capable of receiving an end of the restricting member 540 is formed on a front half of the restricting plate 562. The restricting hole 564 is formed corresponding to the shape of a cross-section of the restricting member 540 and is formed to be somewhat larger than the restricting member 540, thereby allowing the ends of restricting member 540 to be entered the restricting hole 564 according to the right and left movements of the restricting member 540 and to be restricted selectively.

An adjusting hole 566 is formed on the backward of the restricting hole 564. The adjusting hole 566 is formed to be long forward and backward and to be penetratingly engaged by the fixture 568. Therefore, the restricting plate 562 can move forward and backward according to the mounting position of the fixture 568 and the fixing position between the restricting plate and the restricting member 540 can be adjusted, making it possible to adjust the closing position where the door 200 is closed.

Figure 7:
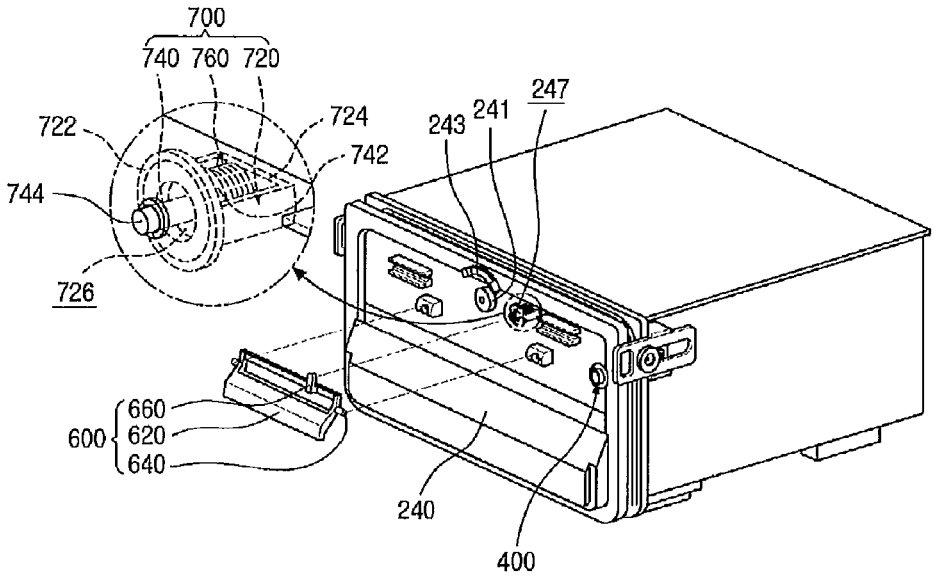
FIG. 7 is a perspective view showing an opening handle and a release means according to an exemplary embodiment of the present invention.

FIG. 7 is a perspective view showing an opening handle and a release means according to an exemplary embodiment of the present invention.

Referring to FIG. 7, an opening handle 600 is provided on an upper side of the restricting device 700. The opening handle 600, which operates a release means 700 to be described in detail later, is positioned approximately in a center portion of the door base 240 and is formed to be pulled forward to be rotatable.

More specifically, the opening handle 600 includes a handle body 620, a rotating shaft 640 and an acting part 660.

The handle body 620, which is held by a user's operation, is formed in a plate shape having a long length from right to left and is formed to be bent so that a user can easily hold the handle body 620. The handle body 620 may be exposed to the front surface of the door cover 220 for the user's operation.

The rotating shafts 640 laterally protruded are formed on both sides of the handle body 620. The rotating shaft 640 is inserted into to fixture formed on the position corresponding to the door base 240 to be rotatably mounted forward according to the user's operation.

The acting part 660 is further formed on the upper portion of the handle body 620. the acting part 660, which operates the opening of the release means 700, protrudes from the upper portion of the handle body 620 to be rotated with respect to the door base 240, if the handle body 620 is pulled forward to be rotated. When the user pulls the handle body 620, the acting part 660 presses one side of the release means 700 by the rotation of the opening handle 600 to open the release means 700.

Meanwhile, the release means 700 is mounted to the door base 240 corresponding to the acting part 660. The release means 700, which allows outside air to be flowed into the inside of the case 100, is in a closed state at normal times to be opened when the opening handle 600 is operated.

The release means 700 includes a valve body 720, a shielding member 740, and an elastic member 760.

More specifically describing a configuration of the release means 700, the valve body 720, which forms a frame of the release means 700, penetrates through the door base 240 to be mounted and includes a mounting part 722 and a supporting part 724.

The mounting part 722, which mounts the release means 700 to the door base 240, is formed in an approximate dose shape and its circumference has a step to be able to be seated to a mounting port 247 formed on the door base 240. An inlet port 726, which becomes an inlet path of outside air, is punched in the approximate center of the mounting part 722.

The supporting part 724 is farmed on a rear surface of the mounting part 722. The supporting part 724, which receives a shielding member 740 and an elastic member 760 to be described later, is formed in an approximate '⊔' letter shape and its opened side contacts the rear surface of the mounting part 722.

In other words, ends of both sides of the supporting part 724 are connected to both sides of the rear surface of the mounting part 722, and the rear surface connecting the both sides of the rear end of the supporting part 724 is formed on the position opposed to the rear surface of the mounting part 722.

The shielding member 740 and elastic member 760 are received in the inner side of the supporting member 724. The shielding member 740, which shields the inlet port 726 of the valve body selectively, includes a shielding plate 724 in an approximate disc shape and a shielding load 744 extended from a center of the shielding plate 742. At this time, the shielding load 744 penetrates through the inlet port 726 of the valve body 720 to be protruded and is selectively pressed by the acting part 660 of the opening handle 600. Therefore, when the opening handle 600 rotates, the shielding plate 742 which shields the inlet port 726 by pressing the shielding load 744 is separated, making it possible to open the inlet port 726.

Meanwhile, the elastic member 760 is interposed between the shielding member 740 and supporting part 724. The elastic member 760, which provides elasticity in order to maintain a state that the shielding member 740 shields the inlet port 726 of the valve body 720, is preferably made of a compression spring.

When the inlet port 726 is opened by the operation of the opening handle 600, the elastic member 760 moves backward to be compressed, and when an external force is removed from the opening handle 600, the shielding member 740 shields the inlet port 726 again by the elasticity of the elastic member 760 and the opening handle 600 is restored to its original position.

The release means 700 may also mounted to the case 100 instead of to door 200, and at this time, an operating member which selectively opens and closes the release means is further provided for operating the release means 700.

Figure 8:
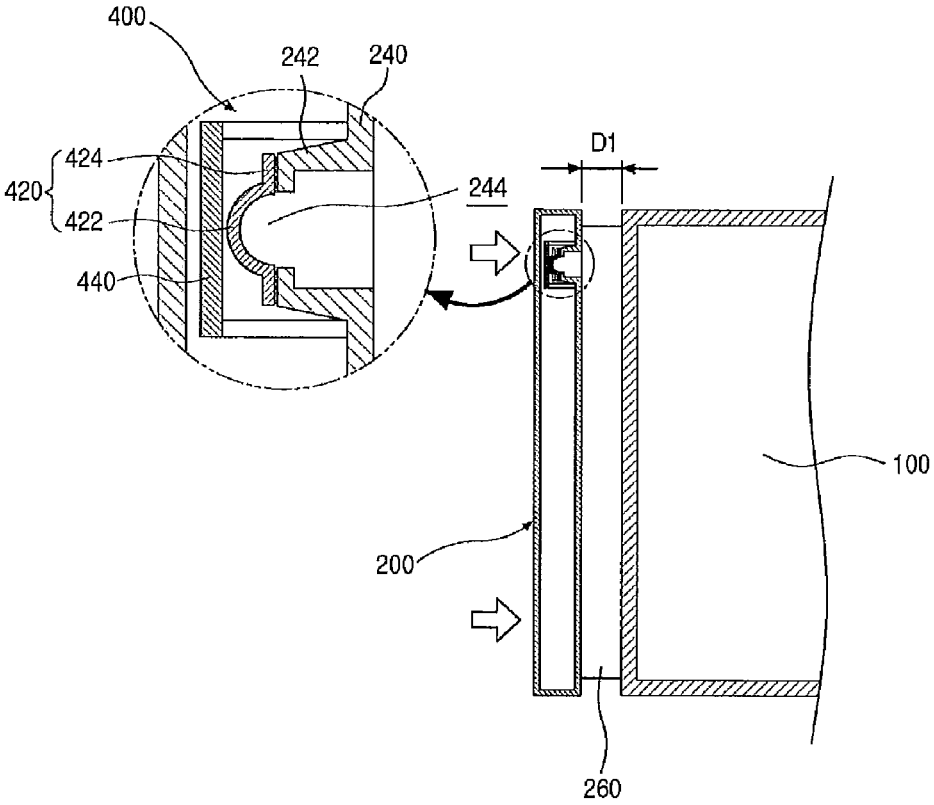
FIGS. 8 to 10 are schematic concept views showing effects of a degassing container according to an exemplary embodiment of the present invention.
Figure 9:
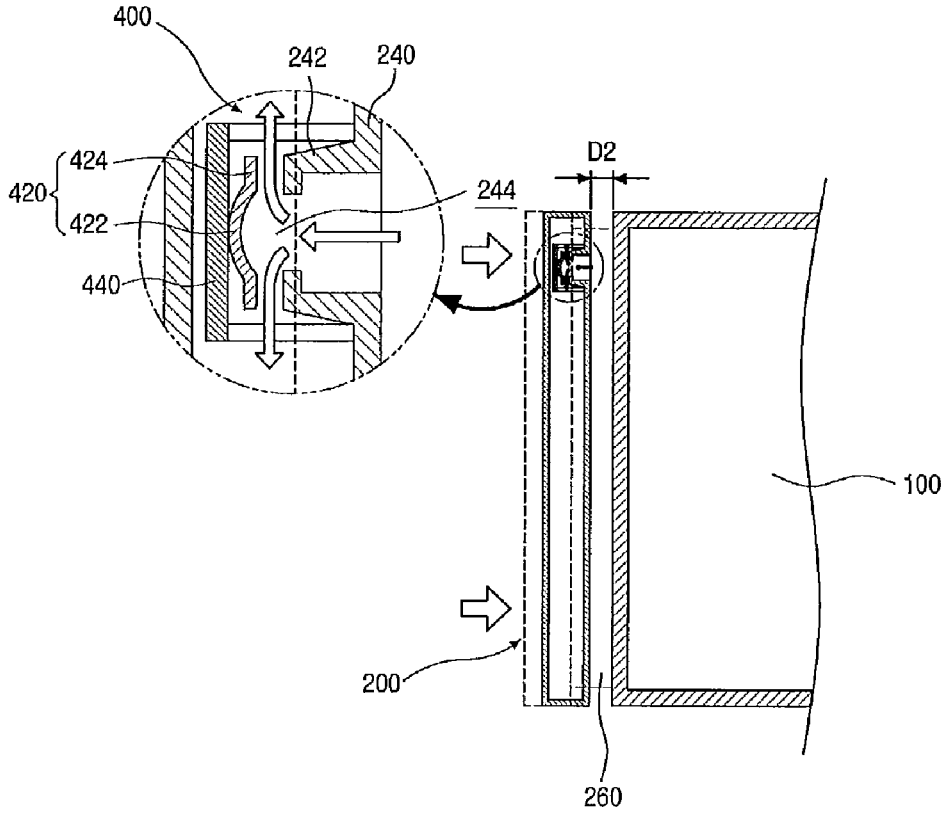
Figure 10:
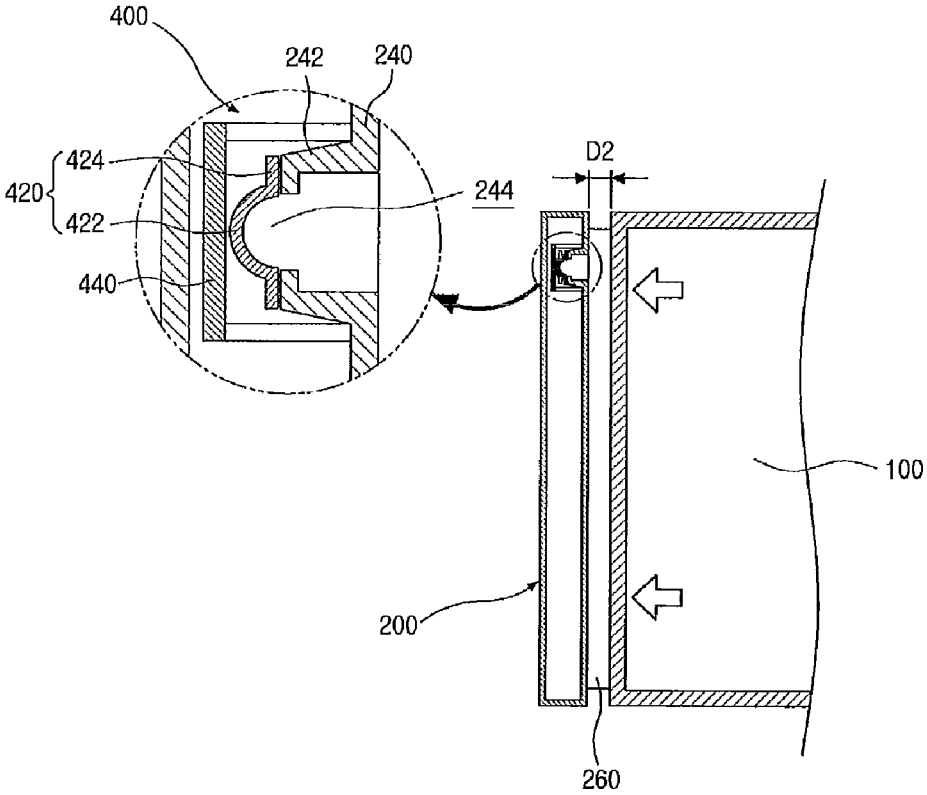

FIGS. 8 to 10 are schematic concept views showing effects of a degassing container according to an exemplary embodiment of the present invention. The effects of the degassing container having the configuration described above will be described with reference to these drawings.

First, FIG. 8 shows a state before a door is tightly closed after being opened, wherein all degassing means 400 and release means 700 provided on the door 200 are in a closed state. When the drawer 300 receiving foods is completely pushed in, the door 200 tightly closes the case.

At this time, a gasket 260 provided on the door 200 contacts a front end of the case 100, wherein the gasket has a width of D1 and the distance between the door and case has also the same width as D1. In this state, when the user more pushes the door 200 into the case 100, the gasket 260 is deformed by its own elasticity and the door 200 is completely adhered to the case 100 to tightly close an inner space of the case 100.

FIG. 9 shows a state that air inside the case is exhausted to the outside. When the gasket 260 in contact with the front end of the case 100 pushes the door 200 even more backward, the gasket 260 is deformed simultaneously with reducing the volume of the space formed by the door 200 and case 100, so the air by the reduced volume is exhausted through the degassing means 400.

In other words, the air inside the case 100 applies pressure to a valve plate 420 through an exhaust port 244 of the degassing means 400 by the pressure generated when the volume is reduced in a closed space to deform the valve plate 420, and the air inside the case 100 is exhausted through the space spaced from the supporting part 242 by the deformation of the valve plate 420.

After air is exhausted by the reduced volume, the pressures is no longer applied to the valve plate 420 and the valve plate 420 is thereby restored to its original shape to shield the exhaust port again, allowing no more air to be entered.

FIG. 10 shows a state that air inside the case is completely exhausted to the outside. When external force pressing the door 200 is removed after the valve plate 420 is closed, the door 200 is completely adhered to the case 100. At this time, the gasket in a compressively deformed state has a width of D2, and the distance between the door 200 and case 100 has the same width as D2. The volume inside the degassing container 10 is reduced by the compression of the gasket 260, and the air inside the case 100 is exhausted by the reduced volume, thereby providing a condition that the storability of foods is improved.

In this state, the inside of the case 100 has a somewhat lower pressure compared to the outside, allowing the door 200 to have more excellent airtight performance and preventing the door 200 from being easily opened.

As considerable portions of air inside the case 100 are exhausted to the outside, the amount of oxygen which causes the oxidation and decay of foods is considerably reduced compared with the volume to improve the storability of foods, and humidity inside the case 100 is also exhausted together with the air exhausted when the gasket 260 is deformed lower the inner humidity, enhancing the storage performance much higher.

When the door 200 is completely adhered to the case 100, restricting members 540 on both right and left sides moves outward by a user's rotational operation on a dial 520 of a restricting device 500 to be coupled to restricting holes 564 of the receiving members 560, preventing an unexpected opening of the door. Through the processes described above, the case 100 can be completed closed, maintaining the door 200 in the closed position.

In order to open the tightly closed case 100 as shown in FIG. 10, the dial 520 of the restricting device 500 is rotatingly operated in a reverse direction, and the restricting members 540 moves inward according to the operation of the dial 520 to be separated from the restricting holes 564 of the receiving members 560.

In this state, a user rotatingly pulls the opening handle 600 forward and an acting part of the opening handle 600 thus presses a shielding load 744 of the release means 700 according to the rotation of the opening handle 600, opening the release means 700.

External air is thereby flowed into the inside of the case 100 in a low pressure state through an inlet port 726 of the release means 700, so the inside and outside of the case have the same pressure, making it possible to open the door 200 with ease.

After the door 200 is opened, the user draws out the drawer 300 to receive or takes out foods in and from the drawer, making it possible to perform his or her desired works.

INDUSTRIAL APPLICABILITY

In a refrigerator and a degassing container of the refrigerator according to present embodiment, degassing means exhausting air inside a case to the outside when a door is closed. therefore, the storage performance improves in a case. thus, industrial applicability is high.

The invention claimed is:

1. A degassing container of a refrigerator, comprising:

a case whose one side is opened;

a door that shields the opened one side of the case selectively;

a gasket interposed between the door and case and elastically deformed to be closely adhered when the door is shielded;

a degassing means provided on the door and exhausting air inside the case to the outside when the gasket is compressively deformed; and a release means provided on the door and flowing external air into an inner side of the case when the door is opened.

2. The degassing container of the refrigerator as claimed in claim 1, wherein the degassing means is configured of a valve, the valve configured to be opened only in a direction permitting air in the inner side of the case to be exhausted to the outside.

3. The degassing container of the refrigerator as claimed in claim 1, further comprising: a handle provided on one side of the door, the handle configured to operate such that the release means can be opened compulsorily.

4. The degassing container of the refrigerator as claimed in claim 1, further comprising:

restricting devices provided on the door and one side of the case, the restricting devices configured to maintain a state that the door is closely adhered to the case.

5. The degassing container of the refrigerator as claimed in claim 4, wherein the restricting means comprises:

a dial provided on the door such that a user can rotatingly operate the dial;

a restricting part provided on a rear surface of the dial, and extended to move right and left according to the rotation of the dial; and a receiving member provided on both sides of the case, and received by end portions of the restricting lever.

6. The degassing container of the refrigerator as claimed in claim 1, wherein a drawer drawn in and out together with the door is provided on the rear surface of the door, and a guide means that guides the drawing in and out of the drawer is further provided on the inner side of the case.

7. The degassing container of the refrigerator as claimed in claim 1, wherein the gasket is formed in a rib shape to be able to be bent outwardly at the time of contact.

8. The degassing container of the refrigerator as claimed in claim 1, wherein the gasket is hollow in its inside to be able to be compressed at the time of contact.

9. A degassing container of a refrigerator, comprising:

a drawer provided in an inner side of a storage space, the drawer capable of being slidingly drawn in and out;

a door drawn in and out together with the drawer and shielding the storage space selectively;

a gasket made of elastically deformable material, the gasket provided on the door and closely adhered to a front end of the storage space; and a degassing means provided on the door or one side of the storage space, the degassing means controlling the entrance and exit of air inside the storage space according to the elastic deformation of the gasket.

10. The degassing container of the refrigerator as claimed in claim 9, wherein the degassing means comprises:

an exhaust port which is an exhaust passage of air inside of the storage space; a valve plate opening the exhaust port selectively by being elastically deformed according to pressure in the inner side of the storage space to guide the exhaust of air inside the storage space to the outside; and a restricting part which restricts the valve plate.

11. The degassing container of the refrigerator as claimed in claim 9, further comprising:

a release means provided on one side of the door, the release means being opened by a user's operation to allow external air to be flowed into the inner side of the storage space.

12. The degassing container of the refrigerator as claimed in claim 11, wherein the release means comprises:

a valve body formed with an entrance hole that air enters through;

a shielding member that shields the entrance hole of the valve body selectively; and an elastic member interposed between the valve body and shielding member and providing elasticity to the shielding member so that the shielding member can shield the entrance hole.

13. The degassing container of the refrigerator as claimed in claim 11, further comprising an opening handle on one side of the door, wherein the opening handle opens the release means and comprises:

a handle body which is held by a user;

rotating shafts formed on both sides of the handle body and rotating the handle body; and an acting part provided on one side of the handle body and pressing and opening the release means according to the rotation of the handle body.

14. The degassing container of the refrigerator as claimed in claim 9, further comprising:

a restricting device provided on one side of the door, the restricting device allowing the door to be restricted to one side of the storage space.

15. The degassing container of the refrigerator as claimed in claim 10, wherein the gasket is provided around a rear surface of the door and is formed to have curvature outward from the rear surface of the door.

16. A refrigerator, comprising:

a body forming a storage space;

one or more refrigerator doors which shield the storage space selectively;

a case provided in the inner side of the storage space and forming a separately partitioned space;

a door that shields an opened front surface of the case selectively;

a gasket provided around a rear surface of the door and closely adhered to the case selectively to be elastically deformed;

a degassing means provided on the door and opened only when the gasket is compressively deformed to allow air inside the case to be exhausted to the outside;

an opening handle mounted to the door and rotatably operated; and a release means provided on the door and selectively opened according to the operation of the opening handle to allow external air to be flowed into the inner side of the case.

17. The refrigerator as claimed in claim 16, wherein the case is selectively detachable to the inner side of the storage space.

18. The refrigerator as claimed in claim 16, wherein a receiving member is formed on the case, and a restricting member is formed on the door and the restricting member is selectively coupled to the receiving member according to a user's operation to maintain the door in a closed state.

19. The refrigerator as claimed in claim 16, wherein a dial that can rotatingly operate is provided on the door, and the restricting member is mounted to the dial and selectively inserted into the receiving member according to the operation of the dial.

20. A refrigerator, comprising:

a body which forms a storage space;

a degassing container provided in the storage space and having a case and a door that shields the case selectively;

a gasket provided between the case and door and compressively deformed when the door is shielded to close an inside of the degassing container;

a degassing means provided on one side of the degassing container and exhausting air inside the case to the outside only when the gasket is compressively deformed; and a release means provided on the other side of the degassing container and allowing air to be selectively flown into the inside of the case according to a user's operation.

21. The refrigerator as claimed in claim 20, wherein a restricting member and a receiving member selectively coupled to each other so as to maintain the door in a shielded state are provided on the door and case, respectively.

22. The refrigerator as claimed in claim 21, wherein the door is provided with a dial coupled to the restricting member to operate the restricting member coupled to the receiving member.

23. The refrigerator as claimed in claim 20, wherein the door is provided with a handle held by a user for opening the door, and the release means is opened when the handle is operated.

24. The refrigerator as claimed in claim 20, wherein a drawer that can be selectively drawn in and out in the inner side of the case is provided to a rear surface of the door.

* * * * *